US010119305B1

(12) United States Patent
McDermit et al.

(10) Patent No.: US 10,119,305 B1
(45) Date of Patent: Nov. 6, 2018

(54) REMOTELY ACTIVATABLE CUSTODY CONTROL BELT

(71) Applicant: Nova Products, Inc, Ponte Vedra Beach, FL (US)

(72) Inventors: John Howard McDermit, Ponte Vedra Beach, FL (US); Jason Edward Havens, Ponte Verde Beach, FL (US)

(73) Assignee: NOVA PRODUCTS, INC, Ponte Vedra Beach, FL (US)

( * ) Notice: Subject to any disclaimer, the term of this patent is extended or adjusted under 35 U.S.C. 154(b) by 0 days.

(21) Appl. No.: 15/614,094

(22) Filed: Jun. 5, 2017

(51) Int. Cl.

| | |
|---|---|
| ***E05B 75/00*** | (2006.01) |
| ***G08B 3/10*** | (2006.01) |
| ***G08C 17/02*** | (2006.01) |
| ***F41H 13/00*** | (2006.01) |

(52) U.S. Cl.
CPC ..... *E05B 75/00* (2013.01); *F41H 13/0012* (2013.01); *G08B 3/10* (2013.01); *G08C 17/02* (2013.01)

(58) Field of Classification Search
None
See application file for complete search history.

(56) References Cited

U.S. PATENT DOCUMENTS 5,841,622 A * 11/1998 McNulty, Jr. ..... F41H 13/0018 361/232
2014/0355167 A1* 12/2014 Reese ..... E05B 75/00 361/232
2016/0040456 A1* 2/2016 Smith ..... E05B 75/00 70/16

* cited by examiner

*Primary Examiner* — Leon-Viet Nguyen

(57) ABSTRACT

A remotely activatable custody control belt is worn by prisoners, inmates, and detainees. The remotely activatable custody control belt deters whomever is wearing the remotely activatable custody control belt from aggressive or hostile actions against law enforcement officers, corrections officers, other prisoners, or bystanders. The remotely activatable custody control belt includes a belt, a belt fastener, a fastener receiver, at least one warning-signal device, a non-lethal electroshock device, a wireless transceiver, and a first microcontroller. The belt is fastened around the prisoner through the belt fastener and the fastener receiver. The at least one warning-signal device alerts the wearer to comply with verbal commands or of an imminent emission from the non-lethal electroshock device. The corrections officer alerts the wearer through a signal from a remote-control device. The signal is received through the wireless transceiver and processed through the first microcontroller.

18 Claims, 11 Drawing Sheets

REMOTELY ACTIVATABLE CUSTODY CONTROL BELT

FIELD OF THE INVENTION

The present invention relates generally to a belt for use by corrections officers. More specifically, the present invention relates to a belt to provide protection for a corrections officer and prisoners by providing the corrections officer with means for preventing hostile actions of a prisoner wearing the belt.

BACKGROUND OF THE INVENTION

Transporting dangerous prisoners poses a potential risk of the endangerment of corrections officers or other prisoners, should the prisoner become hostile. Typically, a prisoner is bound during transportation through restraints including, handcuffs, leg irons, and a belly chain. Theses restraints deter potential attempts by the prisoner to escape or become violent during transportation. In addition, a language barrier exists between corrections officers and prisoners that do not have a common native language. The language barrier makes giving and complying with instructions from the corrections officer difficult.

The present invention is a remotely activatable custody control belt to address these issues encountered by corrections officers to provide effective means for communicating with and control dangerous prisoners during transport or under other circumstances which may require such control. Due to reoccurring hostile tendencies, certain prisoners will often have to be physically confined. In the past, most prisoners in the United States spoke English. Today, English may not be a first language or completely unknown to some prisoners. Therefore, communication between the guard or controlling authority must allow for honest mistakes made by a prisoner regarding commands from a guard or controlling authority. Thus, a safe and effective method of communication from guard to prisoner is necessary. Visual or tactile alert devices allow the corrections officer to indicate to the prisoner that they are not complying with verbal commands. Further, during prisoner transit, prisoners may require restraint to prevent the prisoner from behaving violently and becoming dangerous to themselves and others. The use of shackles may also be included with this invention in those situations involving those prisoners having the most violent records.

DETAIL DESCRIPTIONS OF THE INVENTION

All illustrations of the drawings are for the purpose of describing selected versions of the present invention and are not intended to limit the scope of the present invention.

The present invention is a remotely activatable custody control belt. The present invention assists corrections officers with transporting violent or dangerous criminals. The present invention is worn by a prisoner in order to deter potential conflicts made by the prisoner during transport to escape or cause injury to the corrections officer, other prisoners, or themselves. The corrections officer is able to signal commands to the prisoner through the present invention, if the prisoner is non-responsive to verbal commands. The corrections officer is further able to incapacitate the prisoner using the present invention should the prisoner become hostile.

Figure 1:
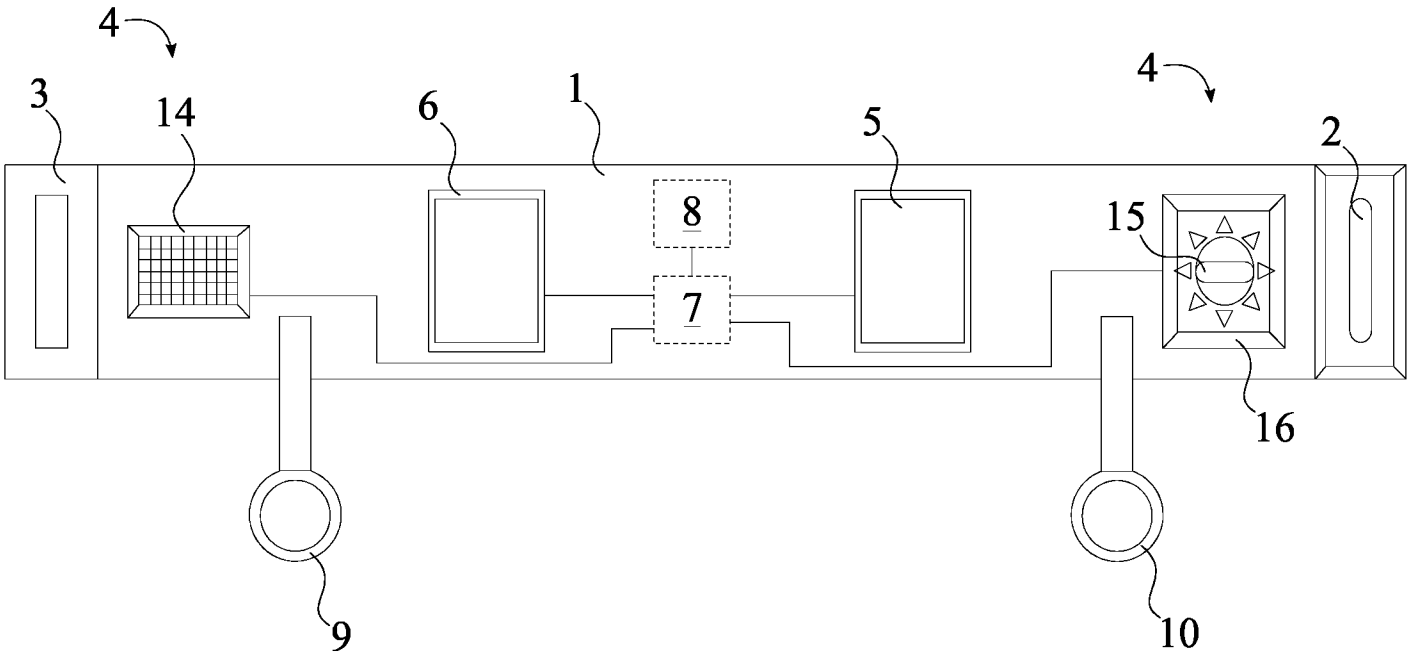
FIG. 1 is a front schematic view of the present invention.

In accordance to FIG. 1, the present invention comprises a belt 1, a belt fastener 2, a fastener receiver 3, at least one warning-signal device 4, a non-lethal electroshock device 5, a wireless transceiver 6, a first microcontroller 7, and a first power source 8. The belt 1 is supported by a waist of the wearer and supports the at least one warning-signal device 4, the non-lethal electroshock device 5, the wireless transceiver 6, the first microcontroller 7, and the first power source 8. The belt 1 positions the non-lethal electroshock device 5 against the wearer. The belt fastener 2 and the fastener receiver 3 secure the belt 1 about the waist of the wearer. The belt fastener 2 is terminally integrated with the belt 1. Similarly, the fastener receiver 3 is terminally integrated with the belt 1. The belt fastener 2 is oppositely positioned to the fastener receiver 3 along the belt 1. The belt fastener 2 selectively engages the fastener receiver 3, in order to clasp the belt 1 into a ring shape. The ring shape is preferred to be diametrically adjustable at the belt fastener 2 and/or the fastener receiver 3, in order to secure the belt 1 about the waist of wearer. The at least one warning-signal device 4 is integrated with the belt 1 in order to be easily perceived by the wearer. The at least one warning-signal device 4 is preferred to comprise an audio alert device 14, a visual alert device 15, and/or a tactile alert device 16, in order to provide a respective notification to the wearer even if the wearer has one or more sensory impairments. The non-lethal electroshock device 5 discharges electricity through the wearer in order to incapacitate the wearer to prevent hostile actions by the wearer. The non-lethal electroshock device 5 is externally integrated with the belt 1, in order for the non-lethal electroshock device 5 to interface with the wearer during implementation of the present invention. The wireless transceiver 6, the first microcontroller 7, and the first power source 8 allow for the present invention to receive control signal inputs, control outputs based on the control signal inputs, and power the electrical components of the present invention. The wireless transceiver 6 is preferred to be radio frequency, Bluetooth, or any other appropriate means for transmitting discrete signals. The wireless transceiver 6, the first microcontroller 7, and the first power source 8 are internally integrated within the belt 1 to prevent tampering by an unauthorized person. The first microcontroller 7 is electrically connected to the first power source 8, in order to receive the necessary electricity for operation. The at least one warning-signal device 4, the non-lethal electroshock device 5, and the wireless transceiver 6 are electronically connected to the first microcontroller 7, in order to process data through the first microcontroller 7 and receive control signals from the first microcontroller 7.

Figure 2:
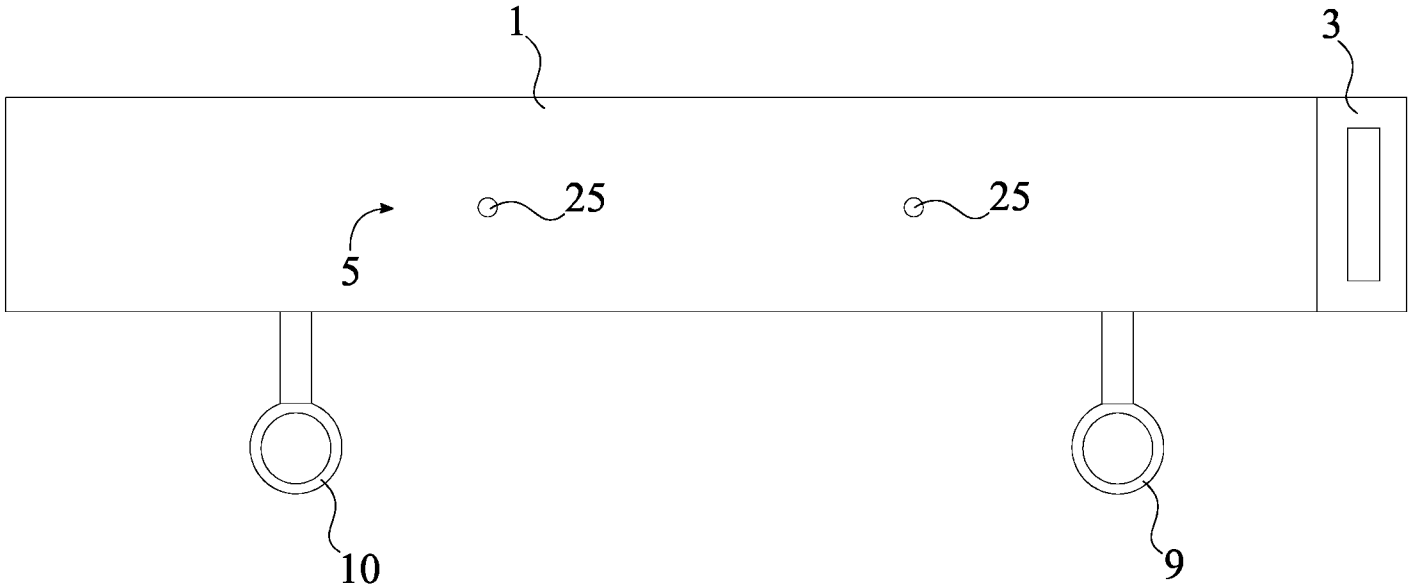
FIG. 2 is a rear view of the present invention.
Figure 3:
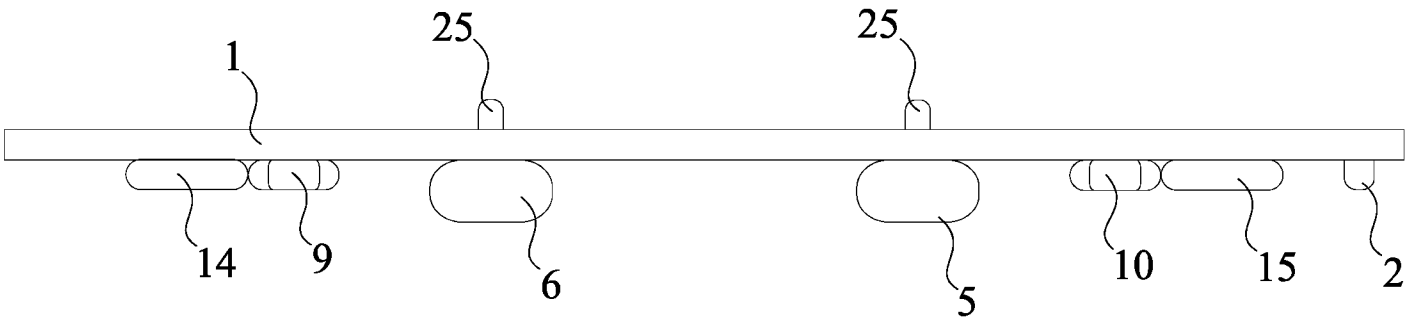
FIG. 3 is a top view of the present invention.
Figure 4:
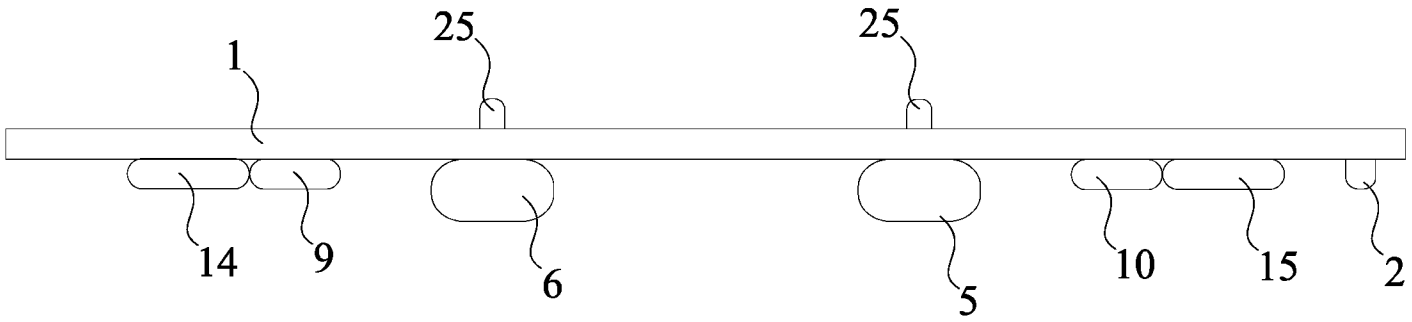
FIG. 4 is a bottom view of the present invention.

More specifically, the non-lethal electroshock device 5 comprises a pair of discharge electrodes 25, in accordance to FIG. 2 to FIG. 4. The pair of discharge electrodes 25 deliver the electroshock to the wearer as a corrections officer signals the present invention to emit the electroshock to prevent hostile actions by the wearer. The pair of discharge electrodes 25 is integrated into the belt 1. The pair of discharge electrodes 25 is oppositely positioned to the at least one warning-signal device 4 about the belt 1, such that the pair of discharge electrodes 25 interfaces with the wearer and the at least one warning-signal device 4 is visible to the wearer. Each of the pair of discharge electrodes 25 is offset from each other, in order to transmit the electroshock through the wearer.

In accordance to the preferred embodiment of the present invention, the at least one warning-signal device 4 comprises an audio alert device 14, shown in FIG. 1. The audio alert device 14 emits an auditory signal, in order to signal an auricularly-capable wearer to comply with a verbal order from the corrections officer. The audio alert device 14 is particularly effective for alerting blind wearers of the belt 1. Detailed in FIG. 1 and FIG. 3 to FIG. 5, the audio alert device 14 is externally integrated with the belt 1 such that the auditory signal is not obfuscated by the belt 1

Further in accordance to the preferred embodiment of the present invention, the at least one warning-signal device 4 comprises a visual alert device 15, shown in FIG. 1. The visual alert device 15 illuminates in order to signal a visually-capable wearer to comply with orders given by the corrections officer through the emission of a light pattern or order indicator. The visual alert device 15 is particularly effective for alerting deaf wearers of the belt 1. The visual alert device 15 is externally integrated with the belt 1, detailed in FIG. 1 and FIG. 3 to FIG. 5. This configuration allows a light emission to be visible to the wearer of the belt 1 without obfuscation of the light emission by the belt 1 or the wearer of the belt 1.

Still in accordance to the preferred embodiment of the present invention, the at least one warning-signal device 4 comprises a tactile alert device 16, shown in FIG. 1. The tactile alert device 16 provides haptic stimulation, through a vibrational pattern, to the wearer of the belt 1, in order to communicate the need to comply with the corrections officer. The tactile alert device 16 is effective for communication with a wearer of the belt 1 that is deaf and/or blind. The tactile alert device 16 is internally integrated with the belt 1, in accordance to FIG. 1 and FIG. 3 to FIG. 5.

In some embodiments of the present invention, the present invention comprises a first arm-restraint receiver 9 and a second arm-restraint receiver 10, shown in FIG. 1 to FIG. 6. The first arm-restraint receiver 9 and the second arm-restraint receiver 10 allow for arm restraints to be tethered to the present invention, in order to restrict the range of motion for the arms of the wearer. The first arm-restraint receiver 9 and the second arm-restraint receiver 10 are externally mounted to the belt 1. The first arm-restraint receiver 9 and the second arm-restraint receiver 10 are positioned between the belt fastener 2 and the fastener receiver 3, as shown in FIG. 1. The first arm-restraint receiver 9 and the second arm-restraint receiver 10 are offset from each other.

Figure 5:
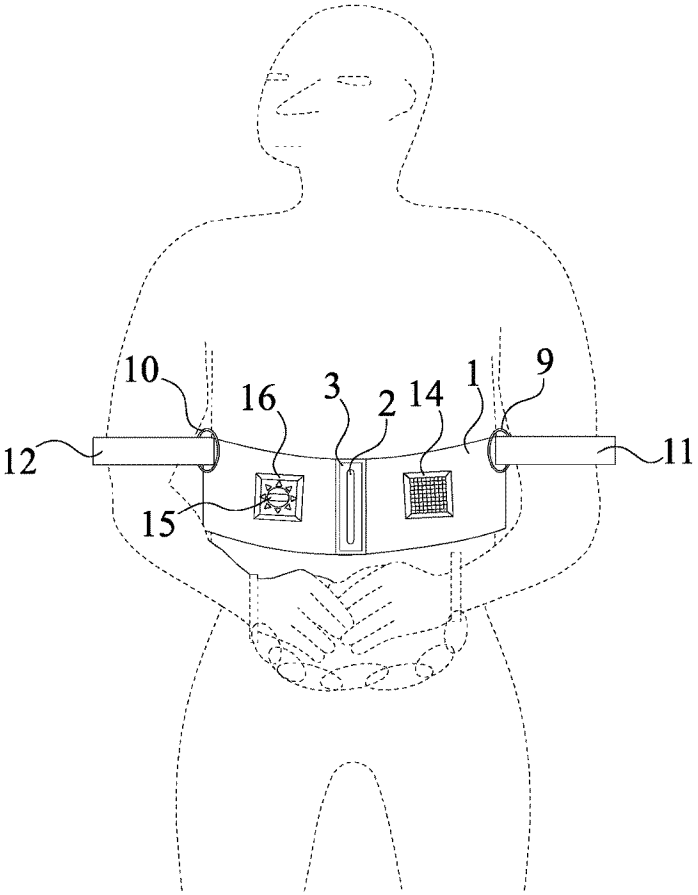
FIG. 5 is a front diagram illustrating the implementation of the present invention, wherein the present invention is worn by a person.
Figure 6:
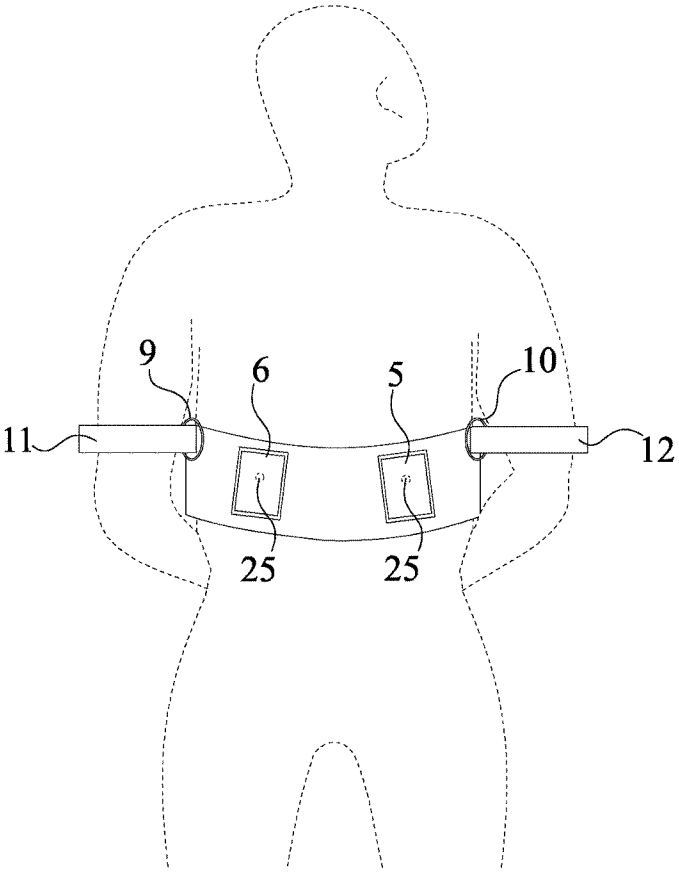
FIG. 6 is a rear diagram illustrating the implementation of the present invention, wherein the present invention is worn by a person.

Further, the present invention comprises a first arm restraint 11 and a second arm restraint 12, in accordance to FIG. 5 and FIG. 6. The first arm restraint 11 and the second arm restraint 12 are secured around each of the wearer's arms. The first arm restraint 11 selectively engages the first arm-restraint receiver 9 in order to limit the range of motion for that arm of the wearer. Similarly, the second arm restraint 12 selectively engages the second arm-restraint receiver 10, in order to limit the range of motion for that arm of the wearer.

In accordance to the preferred embodiment of the present invention, the non-lethal electroshock device 5 emits a high voltage at a frequency of approximately 17-22 pulses per second. The voltage emission of the non-lethal electroshock device 5 is preferred to be between 50,000 and 70,000 volts. The amperage emission for the non-lethal electroshock device 5 is preferred to be between 3 and 6 milliamps and the non-lethal electroshock device 5 has a power output of less than 0.35 joules. This configuration ensures that the wearer will not sustain a continuous or lethal exposure to electrical current from the non-lethal electroshock device 5; however, these values are selected to ensure that the non-lethal electroshock device 5 will subdue the wearer, should the wearer become aggressive.

Figure 7:
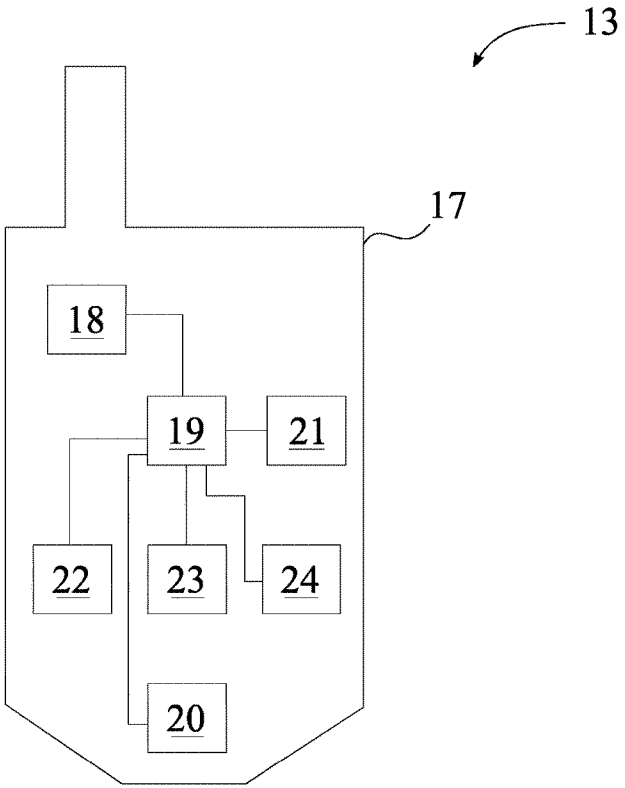
FIG. 7 is a front schematic view of the remote-control device for the present invention.
Figure 8:
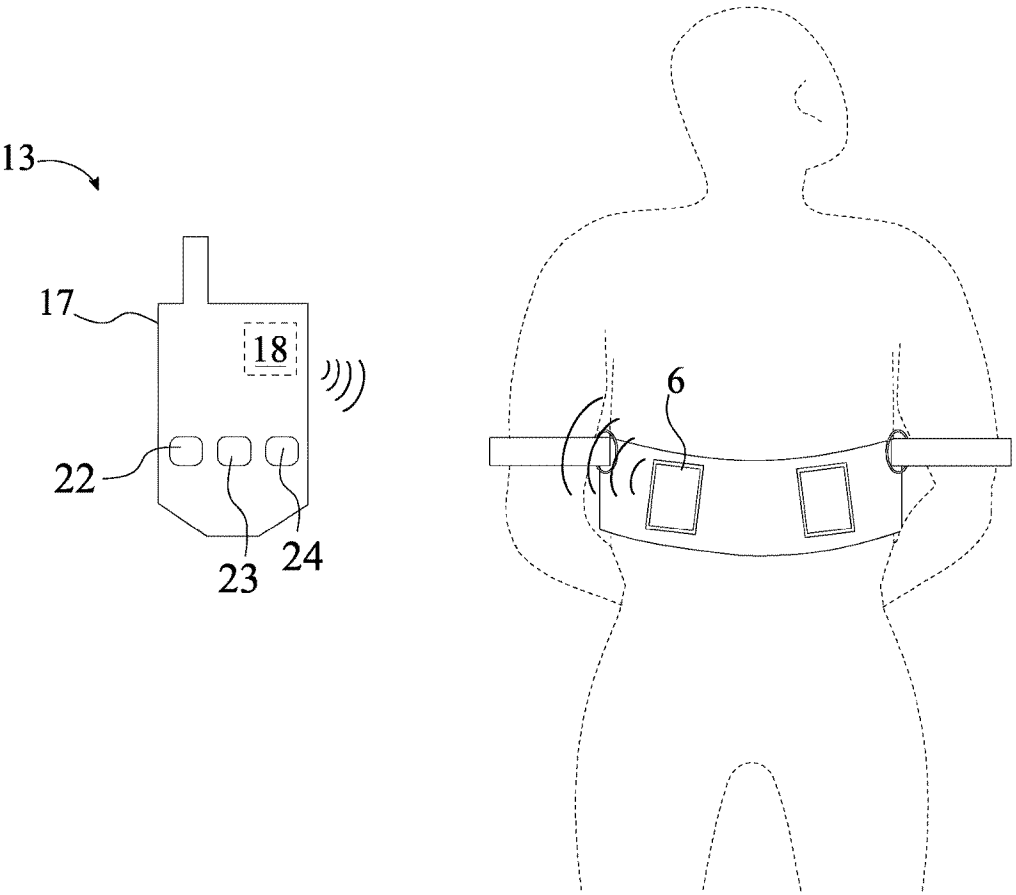
FIG. 8 is a diagram illustrating the communication between the remote-control device and the wireless transceiver for the present invention.

As shown in FIG. 7 and FIG. 8, the non-lethal electroshock device 5 is activated through a remote-control device 13 comprised by the present invention. The remote-control device 13 comprises a housing body 17, a wireless transmitter 18, a second microcontroller 19, a voice-input device 20, a second power source 21, a warning-alert button 22, a shock-emission button 23, and a voice-transmission button 24, detailed in FIG. 7. The housing body 17 provides protection and support for the wireless transmitter 18, the second microcontroller 19, the voice-input device 20, the second power source 21, the warning-alert button 22, the shock-emission button 23, and the voice-transmission button 24. The wireless transmitter 18 transfers a signal to be received by the wireless transceiver 6. The signal is then processed by the first microcontroller 7 to execute the associated output routine for the signal input. The second microcontroller 19 receives inputs from the voice-input device 20, the second power source 21, the warning-alert button 22, the shock-emission button 23, and the voice-transmission button 24 in order to assess the correct signal to transmit to the wireless transceiver 6 through the wireless transmitter 18. The voice input device receives audible commands from a user of the remote-control device 13 to be transmitted with the wireless transmitter 18 to the wireless transceiver 6, to be output through the at least one warning-signal device 4, such as the audio alert device 14, to communicate the audible command to the wearer. The second power source 21 provides electricity to the wireless transmitter 18, the second microcontroller 19, and the voice-input device 20. The warning-alert button 22, the shock-emission button 23, and the voice-transmission button 24 toggle signals with the second microcontroller 19 to be received by the wireless transceiver 6 through the wireless transmitter 18, to be processed by the first microcontroller 7 to output to a respective warning device of the at least one warning-signal device 4.

The wireless transmitter 18, the second microcontroller 19, the voice-input device 20, and the second power source 21 are internally mounted within the housing body 17, in order to be secured and protected by the housing body 17.

The second power source 21 is electrically connected to the second microcontroller 19, in order to power the second microcontroller 19 and attached devices and peripherals. The warning-alert button 22, the shock-emission button 23, and the voice-transmission button 24 are externally integrated with the housing body 17, as shown in FIG. 8. The wireless transmitter 18, the voice-input device 20, the warning-alert button 22, the shock-emission button 23, and the voice-transmission button 24 are electronically connected to the second microcontroller 19 in order for the second microcontroller 19 to manage inputs and outputs from the wireless transmitter 18, the voice-input device 20, the warning-alert button 22, the shock-emission button 23, and the voice-transmission button 24. The wireless transmitter 18 is communicatively coupled with the wireless transceiver 6 in order to transmit the signal from the remote-control device 13 to the belt 1, as shown in FIG. 8.

Figure 9:
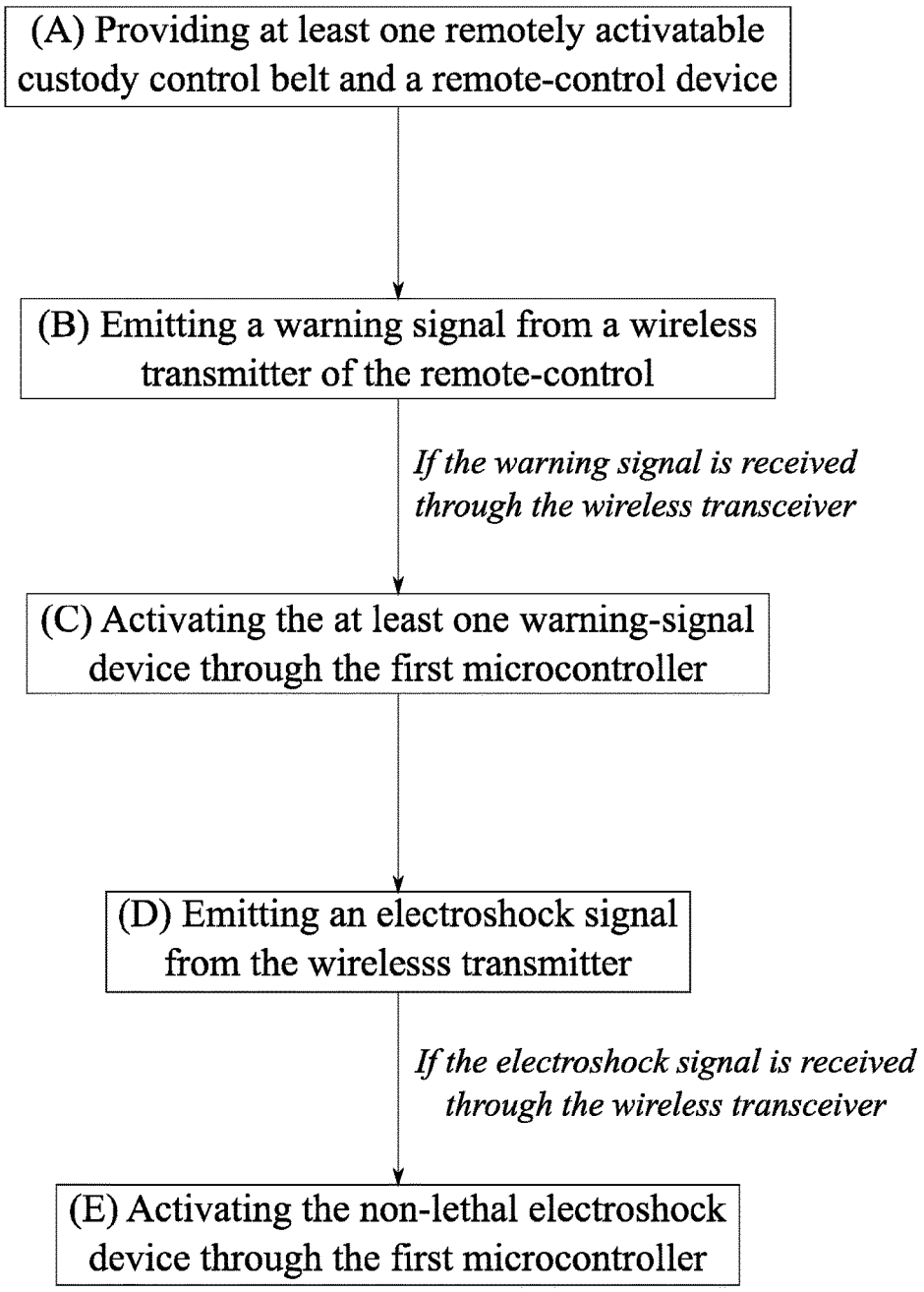
FIG. 9 is a flow diagram for the method of use of the present invention.

For implementation of the present invention detailed in FIG. 9, at least one remotely activatable custody belt is worn by a prisoner for transport and a remote-control device 13 is utilized by a corrections officer. When a prisoner becomes aggressive or displays hostile intentions, the corrections officer issues a warning through the warning-alert button 22. Once the warning-alert button 22 is actuated, the second microcontroller 19 actuates a warning signal to the wireless transmitter 18. The warning signal is then emitted from the wireless transmitter 18. The at least one warning-signal device 4 is then activated through the first microcontroller 7, if the warning signal is received through the wireless transmitter 18. Subsequently, if the prisoner does not comply with warning, the corrections officer is able to take measures by issuing an electroshock to the prisoner to incapacitate the prisoner to prevent any hostile actions. The corrections officer presses the shock emission button to initiate the non-lethal electroshock device 5. This action causes the wireless transmitter 18 to emit an electroshock signal from the wireless transmitter 18. The non-lethal electroshock device 5 is then activated through the first microcontroller 7, if the electroshock signal is received through the wireless transceiver 6.

Figure 10:
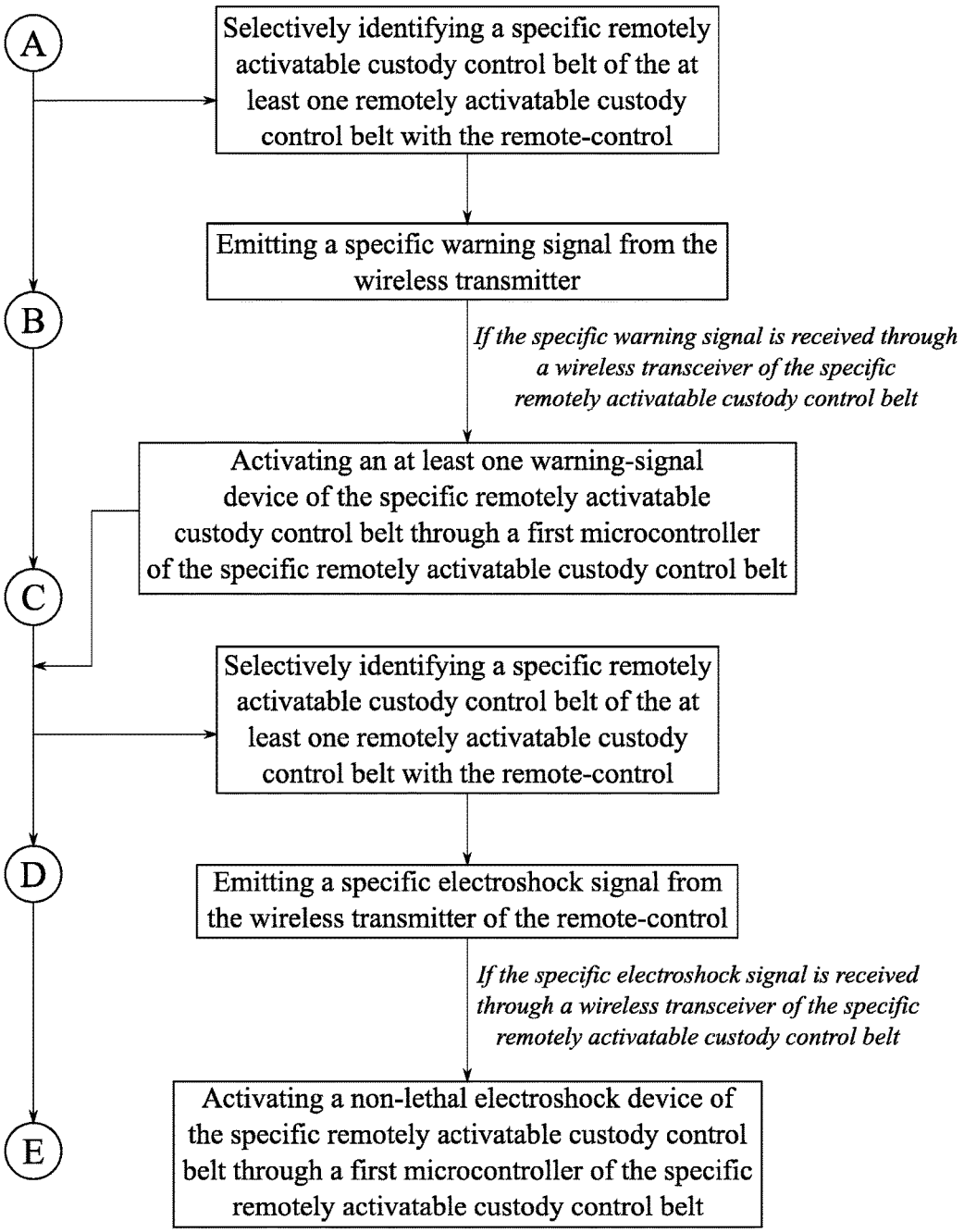
FIG. 10 is a flow diagram for the method of use of the present invention for selectively identifying a custody control belt within the at least one activatable custody control belt.

In accordance to the preferred method of use for the present invention detailed in FIG. 10, a specific remotely activatable custody control belt of the at least one remotely activatable custody belt is selectively identified with the remote-control device 13. This allows the corrections officer to differentiate between different separate custody control belts of the at least one remotely activatable custody belt, and therefore allow the corrections officer to apply control to a specific hostile prisoner amongst a crowd of prisoners. The corrections officer is then able to transmit a specific warning signal to target the specific remotely activatable custody control belt of that specific hostile prisoner. The corrections officer actuates either the warning-alert button 22, the shock-emission button 23, or the voice-transmission button 24 to communicate to the specific prisoner. Subsequently, a specific warning signal is emitted from the wireless transmitter 18. An at least one warning-signal device 4 of the specific remotely activatable custody control belt is activated through a first microcontroller 7 of the specific remotely activatable custody control belt, if the specific warning signal is received through a wireless transceiver 6 of the specific remotely activatable custody control belt. Therefore, the specific prisoner is alerted to comply with the orders of the corrections officer. If the specific prisoner chooses not to comply with the specific warning signal, the corrections officer actuates the shock-emission button 23 to emit an electroshock signal through the wireless transmitter 18. The non-lethal electroshock device 5 is then activated through the first microcontroller 7, if the electroshock signal is received through the wireless transceiver 6 to incapacitate the specific prisoner.

The specific prisoner is alerted in up to three different manners depending on any conditions which the specific prisoner may have. For one embodiment of the present invention, the present invention comprises the at least one warning-signal device 4 being an audio alert device 14, shown in FIG. 11. If the audio alert device 14 is activated, an auditory alert is emitted with the audio alert device 14. The audio alert is a verbal command transmitted through the voice-input device 20 when the corrections officer engages the voice-transmission button 24 or a preloaded audio file stored on the first microcontroller 7.

Figure 11:
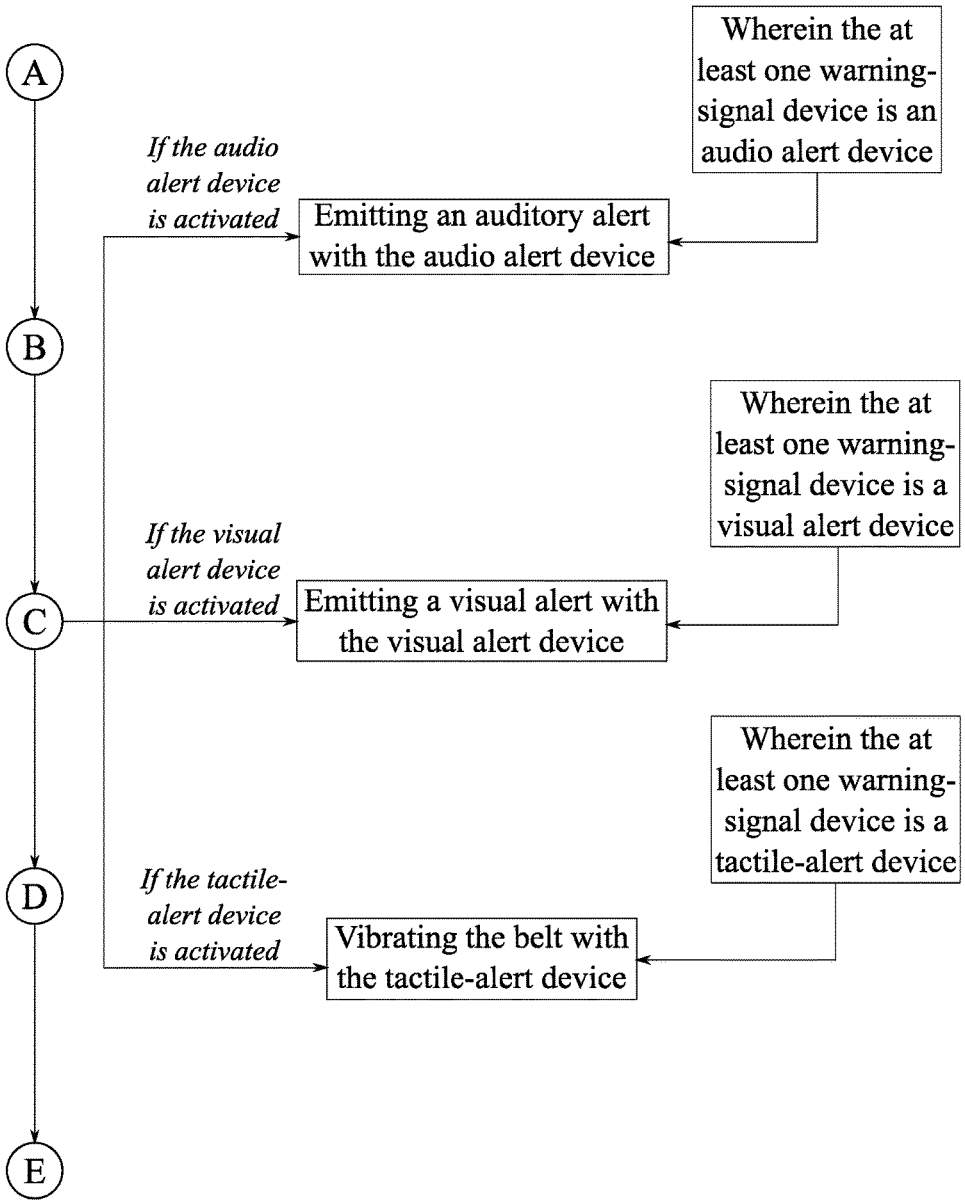
FIG. 11 is a flow diagram for the activation of the at least one warning-signal device.

In some embodiments of the present invention, the present invention comprises the at least one warning-signal device 4 being a visual alert device 15, shown in FIG. 11. If the visual alert device 15 is activated, a visual alert is emitted with the visual alert device 15. The visual alert is a light or pattern of light emission to alert the wearer that a command has been given to the wearer for the wearer to comply. The visual alert device 15 may also be used to indicate if the non-lethal electroshock device 5 is activated, in order to indicate to a corrections officer if the wearer is falsifying a response to the non-lethal electroshock device 5.

In some other embodiments of the present invention, the present invention comprises the at least one warning-signal device 4 being a tactile alert device 16, shown in FIG. 11. If the tactile alert device 16 is activated, the belt 1 of the specific remotely activatable custody control belt is vibrated with the tactile alert device 16 in order to alert the wearer through the sensation of touch that a command has been given for the wearer to comply.

Further in accordance to the preferred embodiment of the present invention, the corrections officer is able to distinguish between specific remotely activatable custody control belts for different wearers, as control for every prisoner wearing a remotely activatable custody control belt may not need to be activated to address hostile actions by a single wearer. Shown in FIG. 10, a specific remotely activatable custody control belt 1 of the at least one least one remotely activatable custody control belt is selectively identified with the remote-control device 13. The remote-control device 13 selectively identifies the specific remotely activatable custody control belt through a corresponding radio frequency, Bluetooth pairing identifier, or a similar means for wirelessly connecting devices. A specific electroshock signal is emitted from the wireless transmitter 18 of the remote-control device 13. The non-lethal electroshock device 5 of the specific remotely activatable custody control belt is activated through the first microcontroller 7 of the specific remotely activatable custody control belt, if the specific electroshock signal is received through the wireless transceiver 6 of the specific remotely activatable custody control belt. Therefore, the wearer of the specific remotely activatable custody control belt will receive an electroshock to deter or incapacitate the wearer from hostile or threatening actions.

Although the invention has been explained in relation to its preferred embodiment, it is to be understood that many other possible modifications and variations can be made without departing from the spirit and scope of the invention as hereinafter claimed.

What is claimed is:

1. A remotely activatable custody control belt system comprising:

a belt;
a belt fastener;
a fastener receiver;
at least one warning-signal device;
a non-lethal electroshock device;
a wireless transceiver;
a first microcontroller;
a power source;
the belt fastener being terminally integrated with the belt;
the fastener receiver being terminally integrated with the belt;
the belt fastener being oppositely positioned to the fastener receiver along the belt;
the belt fastener selectively engaging the fastener receiver;
the at least one warning-signal device being integrated with the belt;
the non-lethal electroshock device being externally integrated with the belt;
the wireless transceiver, the first microcontroller; and the power source being internally integrated within the belt;
the first microcontroller being electrically connected to the power source;
the at least one warning-signal device, the non-lethal electroshock device and
the wireless transceiver being electronically connected to the first microcontroller;
a remote-control device;
the remote-control device comprising a housing body, a wireless transmitter, a second microcontroller, a voice-input device, a second power source, a warning-alert button, a shock-emission button and a voice-transmission button;
the wireless transmitter, the second microcontroller, the voice-input device and the second power source being internally mounted within the housing body;
the second power source being electrically connected to the second microcontroller;
the warning-alert button, the shock-emission button and the voice-transmission button being externally integrated with the housing body;
the wireless transmitter, the voice-input device, the warning-alert button, the shock-emission button and the voice-transmission button being electronically connected to the second microcontroller; and
the wireless transmitter being communicatively coupled with the wireless transceiver.

2. The remotely activatable custody control belt system, as claimed in claim 1, comprising:
the non-lethal electroshock device comprising a pair of discharge electrodes;
the pair of discharge electrodes being integrated into the belt; and
the pair of discharge electrodes being oppositely positioned to the at least one warning-signal device about the belt.

3. The remotely activatable custody control belt system, as claimed in claim 1, comprising:
the at least one warning-signal device comprising an audio alert device;
the audio alert device being externally integrated with the belt; and
the audio alert device being oppositely positioned to the non-lethal electroshock device about the belt.

4. The remotely activatable custody control belt system, as claimed in claim 1, comprising:
the at least one warning-signal device comprising a visual alert device;
the visual alert device being externally integrated with the belt; and
the visual alert device being oppositely positioned to the non-lethal electroshock device about the belt.

5. The remotely activatable custody control belt system, as claimed in claim 1, comprising:
the at least one warning-signal device comprising a tactile alert device; and
the tactile alert device being internally integrated with the belt.

6. The remotely activatable custody control belt system, as claimed in claim 1, comprising:
a first arm-restraint receiver;
a second arm-restraint receiver;
the first arm-restraint receiver and the second arm-restraint receiver being externally mounted to the belt;
the first arm-restraint receiver and the second arm-restraint receiver being positioned between the belt fastener and the fastener receiver; and
the first arm-restraint receiver and the second arm-restraint receiver being offset from each other.

7. The remotely activatable custody control belt system, as claimed in claim 6, comprising:
a first arm restraint;
a second arm restraint;
the first arm restraint selectively engaging the first arm-restraint receiver; and
the second arm restraint selectively engaging the second arm-restraint receiver.

8. The remotely activatable custody control belt system, as claimed in claim 1, wherein the non-lethal electroshock device emits a high voltage at a frequency of approximately 17-22 pulses per second.

9. The remotely activatable custody control belt system, as claimed in claim 1, wherein the non-lethal electroshock device has a voltage emission between 35,000 and 250,000 volts.

10. The remotely activatable custody control belt system, as claimed in claim 1, wherein the non-lethal electroshock device has a voltage emission between 50,000 and 70,000 volts.

11. The remotely activatable custody control belt system, as claimed in claim 1, wherein the non-lethal electroshock device has an amperage emission between 3 and 6 milliamps.

12. The remotely activatable custody control belt system, as claimed in claim 1, wherein the non-lethal electroshock device has a power output of less than 0.35 joules.

13. A method of use for the remotely activatable custody control belt system, as claimed in claim 1, comprising the steps of:
providing at least one remotely activatable custody control belt system with at least one warning-signal device, a first microcontroller, a wireless transceiver, a non-lethal electroshock device and a remote-control device;
emitting a warning signal from a wireless transmitter of the remote-control device;
activating the at least one warning-signal device through the first microcontroller,
if the warning signal is received through the wireless transceiver;
emitting an electroshock signal from the wireless transmitter; and
activating the non-lethal electroshock device through the first microcontroller, if the electroshock signal is received through the wireless transceiver.

14. The method of use for the remotely activatable custody control belt system, as claimed in claim 13, comprising the steps of:

selectively identifying a specific remotely activatable custody control belt system of the at least one remotely activatable custody control belt system with the remote-control device;

emitting a specific warning signal from the wireless transmitter; and activating an at least one warning-signal device of the specific remotely activatable custody control belt system through a first microcontroller of the specific remotely activatable custody control belt system, if the specific warning signal is received through a wireless transceiver of the specific remotely activatable custody control belt system.

15. The method of use for the remotely activatable custody control belt system, as claimed in claim 13, comprising the steps of:

wherein the at least one warning-signal device is an audio alert device; and emitting an auditory alert with the audio alert device, if the audio alert device is activated.

16. The method of use for the remotely activatable custody control belt system, as claimed in claim 13, comprising the steps of:

wherein the at least one warning-signal device is a visual alert device; and emitting a visual alert with the visual alert device, if the visual alert device is activated.

17. The method of use for the remotely activatable custody control belt system, as claimed in claim 13, comprising the steps of:

wherein the at least one warning-signal device is a tactile alert device; and vibrating the belt with the tactile alert device, if the tactile alert device is activated.

18. The method of use for the remotely activatable custody control belt system, as claimed in claim 13, comprising the steps of:

selectively identifying a specific remotely activatable custody control belt system of the at least one remotely activatable custody control belt system with the remote-control device;

emitting a specific electroshock signal from the wireless transmitter of the remote-control device; and activating a non-lethal electroshock device of the specific remotely activatable custody control belt system through a first microcontroller of the specific remotely activatable custody control belt system, if the specific electroshock signal is received through a wireless transceiver of the specific remotely activatable custody control belt system.

* * * * *